United States Patent [19]

Nishida et al.

[11] 4,320,713

[45] Mar. 23, 1982

[54] SMALL WATERCRAFT

[75] Inventors: Hiroshi Nishida, Miki; Keiichi Nakamizo, Himeji; Takemi Inoue, Kakogawa; Takeshi Miyazaki, Miki, all of Japan

[73] Assignee: Kawasaki Jukogyo Kabushiki Kaisha, Kobe, Japan

[21] Appl. No.: 147,987

[22] Filed: May 8, 1980

[30] Foreign Application Priority Data

May 16, 1979 [JP] Japan ..... 54-60965

[51] Int. Cl.[3] ..... B63B 43/14

[52] U.S. Cl. ..... 114/123

[58] Field of Search ..... 9/6 R; 114/270, 123

[56] References Cited

U.S. PATENT DOCUMENTS 3,369,518 11/1966 Jacobson ..... 114/270

3,702,106 11/1972 Wilder ..... 114/123

3,703,877 11/1972 Ueda ..... 114/270

*Primary Examiner*—Trygve M. Blix

*Assistant Examiner*—Thomas J. Brahan

*Attorney, Agent, or Firm*—Jordan and Hamburg

[57] ABSTRACT

A small watercraft having a float on either side of its hull pivotally connected thereto for rotation about a shaft mounted parallel to the direction of movement of the watercraft between a horizontal operative position and a vertical inoperative position taken when the watercraft is stowed away. The floats can be locked in these two positions and in any position as desired between these two positions. Each float is substantially triangular in planar configuration and diverges in going toward the stern of the watercraft. When the watercraft is stationary on the water, the forward end of each float is exposed from the surface of the water; and when the watercraft is planing, each float is exposed in its entirety on the surface of the water.

9 Claims, 4 Drawing Figures

SMALL WATERCRAFT

BACKGROUND OF THE INVENTION

This invention relates to a small watercraft including a hull carrying propulsion means, and more particularly it is concerned with a device for increasing the stability of such watercraft when it is stationary.

In a small watercraft accommodating only one or two persons suitable for use in enjoying motorboating at leisure, particularly a high-speed watercraft of the compact size, it is essential that the width of its hull be minimized to increase its mobility, so long as the area of the bottom of the hull is large enough to ensure that the watercraft cruises smoothly on the water. Even if the beam of the hull is minimized as aforesaid, a lift is produced in the hull by the dynamic pressure of the water acting on the bottom of the hull when the watercraft is cruising, thereby enabling the watercraft to move smoothly while maintaining its stability. However, when the watercraft having a hull of a small width is stationary, the stability of the watercraft is low, and the watercraft may capsize if one tries to get aboard carelessly because of unstability of the watercraft stemming from a lack of enough buoyancy. To obviate this disadvantage, if the size of the hull is increased so as to enable a sufficiently high buoyancy to accommodate the weight of a person or persons as the case may be, an increase in the size of the hull causes a reduction in the gliding performance of the watercraft owing to an increase in the resistance offered by the water brought about by an increase in the area of the portion of the hull in contact with the water, an increase in the weight of the hull, an increase in production cost, and inconvenience in transporting the watercraft on land.

SUMMARY OF THE INVENTION

This invention has as its main object the provision of a small watercraft having increased stability when at rest and facilitating getting aboard of a person or persons using the watercraft.

Another object is to provide a small watercraft having a hull which is so small that the hull has the risk of capsizing when only a person gets aboard the watercraft when at rest on the water because of instability, that is provided with means for avoiding such risk when a person or persons get aboard the watercraft.

Still another object is to provide a small watercraft which is stable and does not capsize even if the watercraft is loaded to its full capacity when at rest on the water.

Still another object is to provide a small watercraft which, despite the fact that it has increased stability when at rest on the water, can be readily transported on land without any trouble.

Still another object is to provide a small watercraft which, despite the fact that it has increased stability when a rest on the water, shows good gliding performance when it is planing.

A further object is to provide a small watercraft which is stable when at rest on the water and capable of quickly shifting to a planing condition when the engine is started.

According to the present invention, there is provided a small watercraft comprising: a hull; and propulsion means mounted on said hull; wherein the improvement comprises; a pair of floats connected to said hull on the port side and the starboard side respectively to increase the stability of the watercraft when at rest, said floats being capable of moving between an operative position in which the floats are substantially horizontal to permit the watercraft to remain at rest or glide on the water and an inoperative position in which they are substantially vertical and stowed away; and means for pivotally supporting said floats so that each said float can be rotated about an axis substantially parallel to the direction of movement of the watercraft.

Additional and other objects, features and advantages of the present invention will become apparent from the description of the embodiment set forth hereinafter when considered in conjunction with the accompanying drawings.

DESCRIPTION OF THE PREFERRED EMBODIMENT

Figure 1:
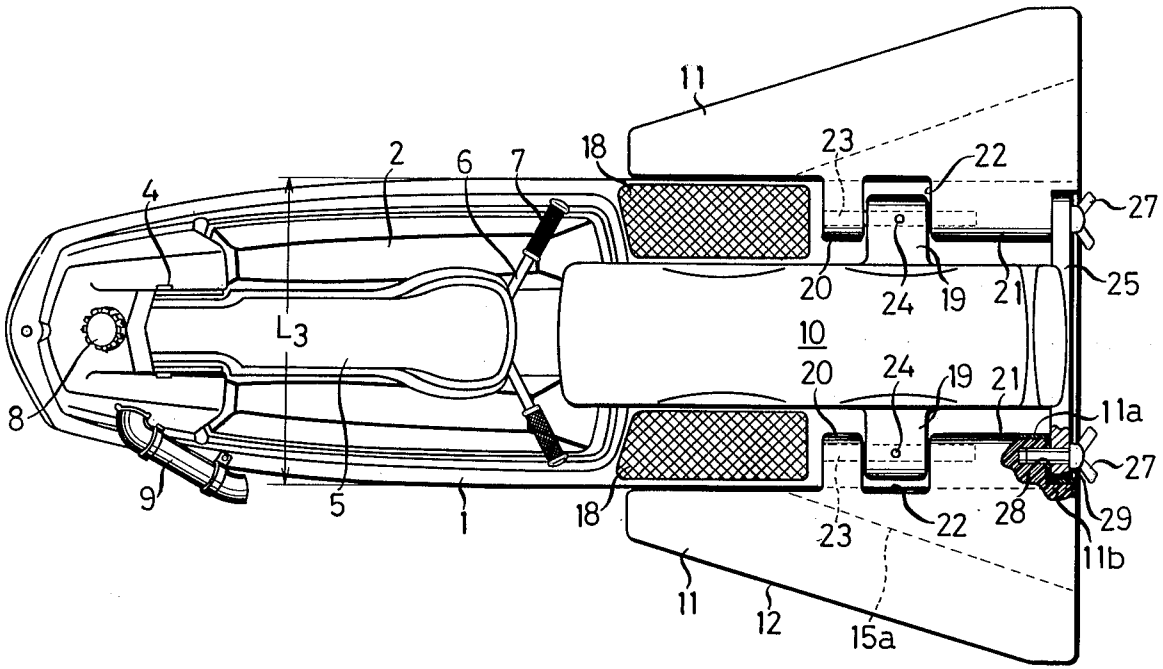
FIG. 1 is a plan view of the small, high-speed watercraft according to the invention having two floats attached to its hull, one float on the port side and the other float on the starboard side.
Figure 2:
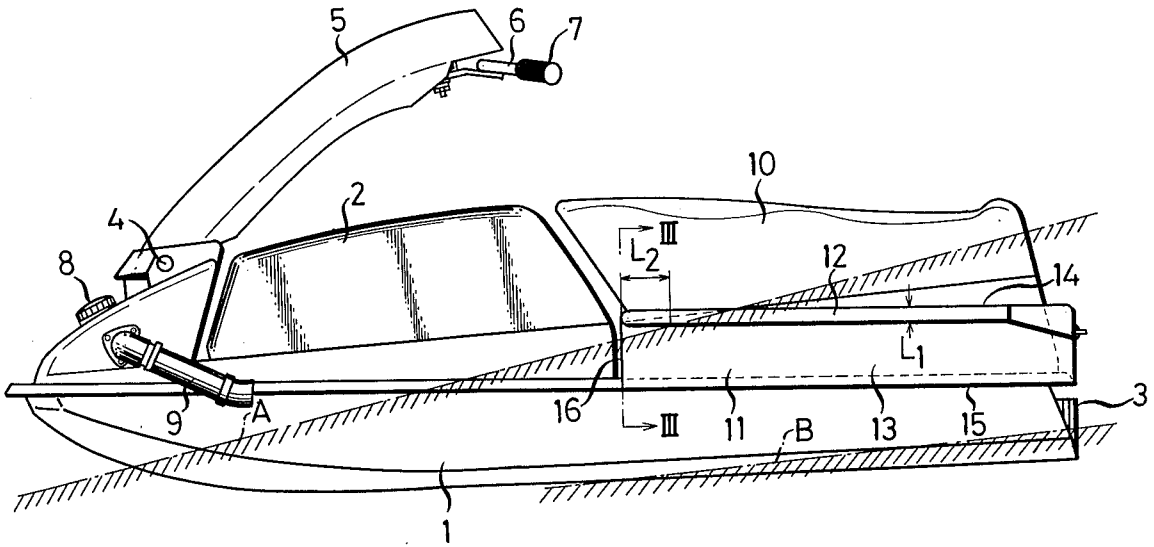
FIG. 2 is a side view of the small craft shown in FIG. 1.

Referring to FIGS. 1 and 2, the small watercraft comprises a hull 1 including an engine room covered with an engine cover 2 disposed in a forward half of the hull 1 for mounting an engine, not shown, which drives a jet pump, not shown, mounted in a rear half of the hull 1. The jet pump includes a duct having a forward end opening on the bottom of the hull, and an impeller in the duct driven by the engine. The impeller increases the pressure of water and the pressurized water is ejected in jet streams rearwardly through a nozzle 3, to propel the hull 1 forwardly by the thrust imparted thereto by the pressurized water.

A handle stem 5 is supported at one end thereof by a horizontal shaft 4 connected to the hull 1 in its forward portion and extending across the length thereof in such a manner that the handle stem 5 can move between a lying position and a standing position. The handle stem 5 has connected to the other end thereof a handle 6 including handle grips 7. By manipulating the handle 6 it is possible to change the direction of the nozzle 3, and by operating one of the handle grips 7 it is possible to control the rpm. of the engine. In the drawings, the numeral 8 designates a fuel inlet cap of a fuel tank, not shown, secured to the hull 1; the numeral 9, an exhaust pipe connected to the engine; the numeral 10, a seat for two persons attached to the hull 1; and the numeral 11, two floats according to the invention connected to the rear half of the hull 1, one float on the port side and the other on the starboard side. A dash-and-dot line A in FIG. 2 represents the surface of the water when the watercraft having two persons aboard is at rest, and a dash-and-dot line B in FIG. 2 indicates the surface of the water when the watercraft having two persons aboard is planing.

The two floats 11 which are connected to the hull 1 symmetrically with center axis of the hull 1 are equal in size, construction and shape to each other, except that they are directed in opposite directions when attached to the hull 1.

Each float 11 is substantially triangular in planar configuration and diverges in going aft along the hull 1 as shown in FIG. 1, and includes an outer shell 11*a* formed of compactly textured, airtight material, such as fiberglass reinforced plastics (FRP), and charged with foamed material 11*b*, although the foamed material 11*b* may be dispensed with to leave the interior of the outer shell 11*a* empty.

Figure 3:
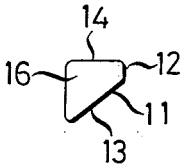
FIG. 3 is an end view as seen in the direction of arrows III—III in FIG. 2.

In FIG. 2, only the float 11 connected to the port side of the watercraft is shown. The floats 11 each include an outer edge portion 12 of a thickness $L_1$, an inclined undersurface portion 13 of a uniform width extending obliquely downwardly from the outer edge portion 12, and an undersurface portion 15 parallel to an upper surface 14 of each float 11 and contiguous with the inclined undersurface portion 13. The boundary between the inclined undersurface portion 13 and undersurface portion 15 extends, as indicated by the numeral 15*a* in FIG. 1, parallel to the outer edge portion 12. Each float 11 also includes a front end surface 16 which is substantially triangular as shown in FIG. 3.

The floats 11 are connected to the port and starboard sides of the hull in positions such that when the watercraft is at rest and the surface of the water is as indicated by the dash-and-dot line A in FIG. 1, a forward end portion of the inclined undersurface portion 13 is exposed above the surface of water A for a length $L_2$ shown in FIG. 2 even if two persons are on board the watercraft, and that when the watercraft is planing the floats 11 are not brought into contact in their entirety with the surface of the water B as shown in FIG. 2.

In FIG. 1, the numeral 18 designates a plurality of foot rests attached to the hull 1 for two persons to place their feet thereon when on board the watercraft. Two box-shaped projections 19 each disposed aft with respect to one of the foot rests 18 (rightwardly in the figure) on the port side or starboard side of the hull 1 extend transversely of the direction of movement of the watercraft. Meanwhile two projections 20 and 21 formed on an end surface of each float 11 facing the hull 1 extend transversely of the direction of movement of the watercraft and define therebetween a recess 22 in which one of the projections 19 of the hull 1 is fitted. The projections 19, 20 and 21 are connected together by a shaft 23 having an axis extending parallel to the direction of movement of the watercraft. More specifically, each shaft 23 extending through an aperture formed in each projection 19 of the hull 1 and secured to the projection 19 by means of a set bolt 24 is journalled at opposite ends thereof by bearing, not shown, located in the projections 20 and 21 of the float 11. By this arrangement, each float 11 is supported by one of the shafts 23 and capable of moving in pivotal movement about the axis of each shaft 23 so that each float 11 can be moved between an operative position shown in solid lines in FIGS. 1, 2 and 4 and an inoperative position shown in dash-and-dot lines in FIG. 4 in which the floats 11 are stowed away or moved to any position as desired between the operative and inoperative positions.

Figure 4:
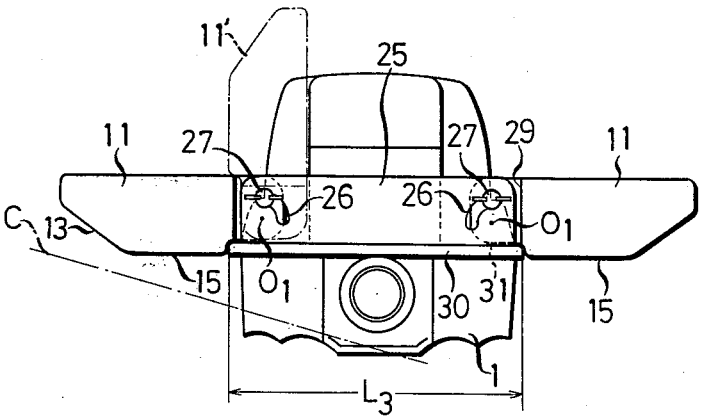
FIG. 4 is a view of the small watercraft shown in FIG. 2 as seen from its rear or from the right in FIG. 2, with certain portions being omitted.

Each float 11 can be locked in any of the aforesaid positions by a mechanism presently to be described. A bar-shaped bracket 25 connected to the hull 1 extends transversely of the length of the watercraft at the stern, and is formed with two arcuate slots 26 each centered at the center $0_1$ of one of the shafts 23 as shown in FIG. 4. A butterfly bolt 27 is passed in each arcuate slot 26 from the rear and threaded into a threaded opening 28 (See FIG. 1) formed in one of the projections 21 of the float 11. By tightening the butterfly bolts 27, it is possible to secure the floats 11 to the bracket 25. Each float 11 is offset at 29 at its rear end for fitting one end of the bracket 25 therein. Each float 11 is offset at 31, as shown in FIG. 4, at an end of the bottom surface 15 facing the hull 1 for accommodating a deck 30. By tightening the butterfly bolts 27 while the offset portions 31 are in abutting engagement with the deck 30, the floats 11 can be maintained in the operative position in which the floats 11 extend horizontally transversely of the hull 1. The deck 30 has the function of keeping the floats 11 from moving downwardly.

As can be clearly seen in the drawings, the hull 1 itself (that is, when the floats 11 are not attached thereto) is so small to reduce the resistance offered by the water when the watercraft is gliding on the water that it may capsize if a person carelessly gets aboard when at rest because of a lack of enough stability. More specifically, the hull 1 has a beam $L_3$ (See FIG. 1) which is set at a level substantially equal to or slightly smaller than the breadth of the driver's shoulder. The floats 11, which are connected symmetrically to the port side and the starboard side of the hull 1 for angular rotation about the shafts 23 and can be locked in any position as desired, each have a size such that the two floats 11 combined have a volume large enough to develop a buoyancy commensurate with the loading capacity of the hull 1. Each float 11 has a length which is at least $\frac{1}{3}$ or more of the total length of the hull 1 as measured in the direction of movement of the watercraft. The reason why the aforesaid value is adopted for the length of the floats 11 is as follows. When a person sits on the seat 10 at the stern, the watercraft will be submerged in the water at the stern due to the added weight of the person, to be brought to a tilting position. At this time, the floats 11 themselves will offer resistance and make planing impossible, unless a portion of the forward edge portion of each float 11 remains above the water. The results of tests conducted to optimize the length of the floats 11 relative to the length of the hull 1 show that if at least a part of the forward edge portion of each float 11 remains above the water the floats 11 can help the watercraft perform planing by being subjected to suitable hydraulic pressure. Thus if the floats 11 are attached to the rear half of the hull 1 and their length is at least $\frac{1}{3}$ or more of the total length of the hull 1, the floats 11 can serve the purpose for which they are intended. Each float 11 is connected to the hull 1 in a position higher from the surface of the water such that at least during the gliding movement of the watercraft the undersurface portion 15 clears the surface of the water B (See FIG. 2). In the illustrated embodiment, each float 11 is constructed such that it is supported by one of the shaft 23 for movement between a substantially horizontal operative position taken when the watercraft is at rest or gliding on the water and a substantially vertical position taken when the watercraft is inoperative and the floats 11 are stowed away. When in the vertical position, the floats 11 can be supported on the edges of the seat 10 to remain within the beam of the hull 1 (See FIG. 4).

Operation of the watercraft constructed as aforesaid will now be described. When the floats 11 are locked in the substantially horizontal operative position shown in solid lines in FIGS. 1, 2 and 4 and two persons get aboard the watercraft, the hull 1 will be submerged under the water at the stern with respect to the surface of water A as shown in FIG. 2. As described hereinabove, the hull 1 is very unstable when at rest, but the floats 11 projecting from the rear half of the hull 1 on the port side and the starboard side thereof have the function of imparting added buoyancy to the hull 1 when at rest, so that the hull 1 is stable and does not capsize when persons get aboard the watercraft. With the seat 10 being occupied to its full capacity of with two persons on the seat 10, the undersurface of forward edge portion of each float 11 clears the surface of the water A for the length $L_2$ as shown in FIG. 2. When the engine speed is accelerated in this condition to eject at high speed the pressurized water through the nozzle 3, forwardly directed thrust is applied to the hull 1 and the watercraft moves forwardly. Since the undersurface of the forward edge portion of each float 11 clears the surface of the water as aforesaid, a hydraulic pressure sufficiently high to enable the hull 1 to perform planing is applied to the floats 11 and the stern of the watercraft quickly appears on the water, so that the surface of the water relative to the hull 1 is brought to the condition indicated at B in FIG. 2. When the hull 1 is in this condition, the watercraft can attain a high speed and the riders can enjoy high-speed cruising to their hearts' content.

As aforesaid, each float 11 having a substantially triangular planar configuration includes the inclined undersurface portion 13 tilting upwardly in going toward its side remote from the hull 1. Because of this structural feature, when the hull 1 begins to shift to planing, the water smoothly flows along the inclined undersurface portion 13 of the floats 11, thereby minimizing the resistance offered by the water to the shifting of the hull 1 to planing and at the same time increasing the lift acting on the floats 11. Thus shifting of the hull 1 to planing is promoted. These effects can be achieved even if each float 11 has an inclined surface at the forward edge portion thereof alone.

When the hull 1 finished shifting to planing, the floats 11 clear the surface of water B. Thus the floats 11 essentially offer no resistance to the smooth movement of the hull 1 on the water and cause no reduction in the gliding performance of the watercraft. When the driver shifts body weight leftwardly to turn the watercraft to the left, the surface of water will be as indicated at C in FIG. 4. The inclined undersurface portion 13 and undersurface portion 15 of each float 11 have a configuration designed such that the floats 11 clear the surface of water C when the watercraft makes a turn.

When the watercraft is withdrawn from the water and transported on land, each butterfly bolt 27 is loosened and each float 11 is rotated about each shaft 23 extending lengthwise of the hull 1 to move to its substantially vertical, stowed-away position as indicated at 11' in FIG. 4 in which each float 11 is disposed on one marginal portion of the seat 10. When in this inoperative position, the two floats 11 are disposed within the beam $L_3$ of the hull 1, so that transportation of the watercraft is facilitated because the watercraft has substantially the same bulk as a watercraft having no floats.

In the embodiment shown and described hereinabove, the butterfly bolt 27 is used for locking each float 11 to the hull 1. However, the invention is not limited to this specific locking means, and any other suitable clamping means, latch means, recoil preventing pin means, etc., may be used. Also, the angular position of the floats 11 with respect to the float 1 may be adjusted by remote control from the driver's seat by using a control device such as hydraulic cylinder means, ect. The use of a control device offers the additional advantage that the angular position of the floats can be adjusted as desired while in gliding movement and the floats can be made to clear the surface of the water by adjusting the angular position of the floats even if the angle of inclination of the hull is increased when the watercraft makes a turn.

What is claimed is:

1. A small watercraft comprising:

a hull;

propulsion means mounted on said hull; and a pair of floats connected to said hull on the port side and the starboard side respectively to increase the stability of the watercraft when at rest, said floats being capable of moving between an operative position in which the floats are substantially horizontal to permit the watercraft to remain at rest or glide on the water and an inoperative position in which they are substantially vertical and stowed away; said floats each disposed to remain above the surface of the water when the watercraft is gliding with only the forward end of each float exposed above the surface of the water when the watercraft is at rest and loaded to full capacity, said floats each substantially triangular in planar configuration, diverging in the direction of the stern, said floats each having an inclined undersurface of substantially uniform width extending obliquely downwardly from the outer edge portion thereof.

2. A small watercraft as claimed in claim 1, further comprising locking means for locking said floats in any positions including said operative position and said inoperative position with respect to the hull.

3. A small watercraft as claimed in claim 1 or 2, wherein said floats are stowed away in a position within the beam of the hull when in said inoperative position.

4. A small watercraft as claimed in claim 1 or 2, wherein said floats are connected to a rear half of said hull.

5. A small watercraft as claimed in claim 1, wherein said floats are each connected to said hull in a position above the surface of the water when the watercraft is in a planing position.

6. A small watercraft as claimed in claim 1, wherein said floats are each connected to said hull in a position with a forward end of each said float exposed above the surface of the water when the watercraft is at rest and loaded to full capacity.

7. A small watercraft as claimed in claim 6, wherein said floats each have a length at least $\frac{1}{3}$ of the total length of the hull as measured in the direction of movement of the watercraft.

8. A small watercraft as claimed in claim 1, 5 or 6, wherein said floats connected to the port side and the starboard side respectively of the watercraft are symmetrical with respect to the hull.

9. A small watercraft as claimed in claim 1 additionally comprising means for pivotally supporting said floats allowing each float to be rotated about an axis extending substantially parallel to the direction of movement of the watercraft.

* * * * *